US008702268B1

(12) United States Patent
Rashidi

(10) Patent No.: US 8,702,268 B1
(45) **Date of Patent: *Apr. 22, 2014**

(54) 2×4 DAWN LIGHT VOLUMETRIC FIXTURE

(76) Inventor: Hamid Rashidi, Commerce, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/475,211

(22) Filed: May 18, 2012

(51) Int. Cl.

| | |
|---|---|
| ***F21V 21/00*** | (2006.01) |
| ***F21V 1/00*** | (2006.01) |
| ***F21V 5/00*** | (2006.01) |
| ***F21V 7/00*** | (2006.01) |
| ***F21S 4/00*** | (2006.01) |
| ***F21S 8/00*** | (2006.01) |

(52) U.S. Cl.
USPC ..... 362/217.01; 362/147; 362/217.15; 362/217.05; 362/217.1; 362/223

(58) Field of Classification Search
USPC ..... 362/147, 148, 217.05, 217.02, 217.1, 362/249.02, 241, 245, 364, 296.01, 308, 362/327, 20, 217.01, 217.15, 223
See application file for complete search history.

(56) References Cited

U.S. PATENT DOCUMENTS

| | | | | | |
|---|---|---|---|---|---|
| 3,710,094 | A * | 1/1973 | Monte et al. | 362/218 |
| 3,860,829 | A * | 1/1975 | Fabbri | 307/66 |
| 4,549,253 | A * | 10/1985 | Totten | 362/364 |
| 4,928,209 | A * | 5/1990 | Rodin | 362/221 |
| 5,440,466 | A * | 8/1995 | Belisle et al. | 362/222 |
| 5,823,663 | A * | 10/1998 | Bell et al. | 362/362 |
| 5,988,829 | A * | 11/1999 | Holder | 362/223 |
| 6,092,913 | A * | 7/2000 | Edwards, Jr. | 362/260 |
| 6,367,955 | B1 * | 4/2002 | Rhee | 362/368 |
| 6,752,513 | B2 * | 6/2004 | Plunk | 362/150 |
| 6,854,860 | B2 * | 2/2005 | Plunk | 362/147 |
| 6,908,212 | B2 * | 6/2005 | Schultz | 362/220 |
| 7,296,910 | B2 * | 11/2007 | Mayfield et al. | 362/217.05 |
| 7,510,305 | B2 * | 3/2009 | Straton et al. | 362/294 |
| 7,635,198 | B2 * | 12/2009 | Mayfield et al. | 362/220 |
| 7,794,119 | B2 * | 9/2010 | Venhaus | 362/346 |
| 7,901,105 | B2 * | 3/2011 | Fowler et al. | 362/217.15 |
| 7,922,351 | B2 * | 4/2011 | Welker | 362/217.11 |
| 7,963,662 | B2 * | 6/2011 | Chung et al. | 362/223 |
| 8,100,551 | B2 * | 1/2012 | Mayfield et al. | 362/223 |
| 8,272,763 | B1 * | 9/2012 | Chinnam et al. | 362/249.07 |
| 8,360,620 | B1 * | 1/2013 | Rashidi | 362/364 |
| 2004/0184264 | A1 * | 9/2004 | Elam et al. | 362/148 |
| 2005/0201094 | A1 * | 9/2005 | Plunk | 362/260 |
| 2005/0281023 | A1 * | 12/2005 | Gould et al. | 362/217 |
| 2005/0281024 | A1 * | 12/2005 | Mayfield et al. | 362/221 |
| 2010/0118525 | A1 * | 5/2010 | Chung et al. | 362/223 |
| 2010/0224404 | A1 * | 9/2010 | Rippel et al. | 174/520 |
| 2011/0051403 | A1 * | 3/2011 | Owen | 362/157 |
| 2011/0211343 | A1 * | 9/2011 | Chung et al. | 362/223 |
| 2012/0120645 | A1 * | 5/2012 | Hawkins et al. | 362/225 |

* cited by examiner

*Primary Examiner* — Jong-Suk (James) Lee
*Assistant Examiner* — Erin Kryukova
(74) *Attorney, Agent, or Firm* — Thomas I. Rozsa

(57) ABSTRACT

A recessed lighting fixture which utilizes a fluorescent light source. The fluorescent lights are shrouded by a diffuser lens basket so that light from the fluorescent bulbs shining through the diffuser is dispersed to reduce glare and visibility of the source of light. It is an object of the present invention to provide a fluorescent recessed lighting fixture which has the illumination from the fluorescent bulbs shining through a diffuser. It is also an object of the present invention to provide a single driver or ballast within the body of the fixture where access can only be gained from below the fixture.

32 Claims, 17 Drawing Sheets

2×4 DAWN LIGHT VOLUMETRIC FIXTURE

BACKGROUND OF THE INVENTION

1. Field of the Invention

The present invention relates to the field of recessed lighting systems which utilize fluorescent lighting to provide non-glaring interior lighting.

2. Description of the Prior Art

In general, the concept of utilizing fluorescent lights in recessed lighting fixtures has been known. However, the source of illumination is frequently visible, making for an unattractive source of lighting.

In the prior art, there have been various lighting fixtures which provide direct lighting. However, in most of these cases, the source of illumination is frequently visible to the individuals in the room in which the light is being used. Another embodiment includes a fluorescent lamp and a lens having prismatic elements for distributing the light. There are also some light fixtures which include parabolic fixtures in the light.

The most common source of indoor lighting, especially for business uses, has been a fluorescent lighting fixture. One problem with fluorescent lighting fixtures is sometimes they emit light which is too bright for the area.

Another disadvantage that is found in traditional parabolic and prismatic troffers is the presence of distracting dynamic changes in brightness level and patterns as seen by a moving observer in the architectural space.

There have been various sources of solutions to resolve the problems with the prior art. One example is found in U.S. Pat. No. 7,229,192 issued to Mayfield, III et al. on Jun. 12, 2007, for "LIGHT FIXTURE AND LENS ASSEMBLY FOR SAME". In that patent, the disadvantages of light fixtures using brighter light sources by providing a configuration that appears to the viewer as though it has a source of lower brightness, but which otherwise permits the light fixture to advantageously and efficiently distribute the light generated by the selected lamp such as T5 lamp was allegedly resolved. The light fixture of that invention reduces directing direct light glare associated with high brightness light sources used in direct or indirect light fixtures. While the advantages of this patent are certainly of benefit, there is still significant room for improvement to improve the ability to reduce brightness and glare of sources of illumination from fluorescent bulbs.

SUMMARY OF THE INVENTION

The present invention is a recessed lighting fixture which utilizes a fluorescent light source. The fluorescent lights are shrouded by a diffuser lens basket so that light from the fluorescent bulbs shining through the diffuser is dispersed to reduce glare and visibility of the source of light.

The present invention relates to a light fixture for efficiently distributing light emitted by a light source into an area to be illuminated. The invention includes a light reflector assembly that supports the light source. A significant innovation of the present invention is that the light reflector assembly is straight and is neither concave nor convex but instead, provides a straight angular reflector which serves to improve the light source emission from fluorescent bulbs.

The light fixture also includes a lens assembly positioned with respect to the source of illumination, which lens assembly is removably affixed in the manner as will be described hereinafter. In the preferred embodiment, the fixture includes two parallel lenses which are spaced apart and cover separate fluorescent tubes.

In one embodiment of the present invention, the reflector assembly of the light fixture includes a base member that extends longitudinally between spaced edges along a longitudinal access. At least a portion of the base member can form a reflective surface which is preferably a straight non-curved reflecting surface. The light fixtures is typically higher up in the structure so that the illumination can be dimmed by the reflector assembly and lens as set forth hereinafter.

It is an object of the present invention to provide a fluorescent recessed lighting fixture which has the illumination from the fluorescent bulbs shining through a diffuser which can be made of frosted acrylic material or perforated metal so that the illumination appears to come from a fluorescent light.

It is an additional object of the present invention to provide an access door in the top of the fixture so that access to a driver or ballast retained within the fixtures can be provided from the top of the fixture.

It is an object of the present invention to provide a fluorescent recessed lighting fixture which has the illumination from the fluorescent bulbs shining through a diffuser.

It is also an object of the present invention to provide a single driver or ballast within the body of the fixture where access can only be gained from below the fixture.

It is also an object of the present invention to provide a second emergency ballast in line with the main ballast.

It is an additional object of the present invention to incorporate the above novel features into a fixture which utilizes fluorescent light bulbs as the source of illumination.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
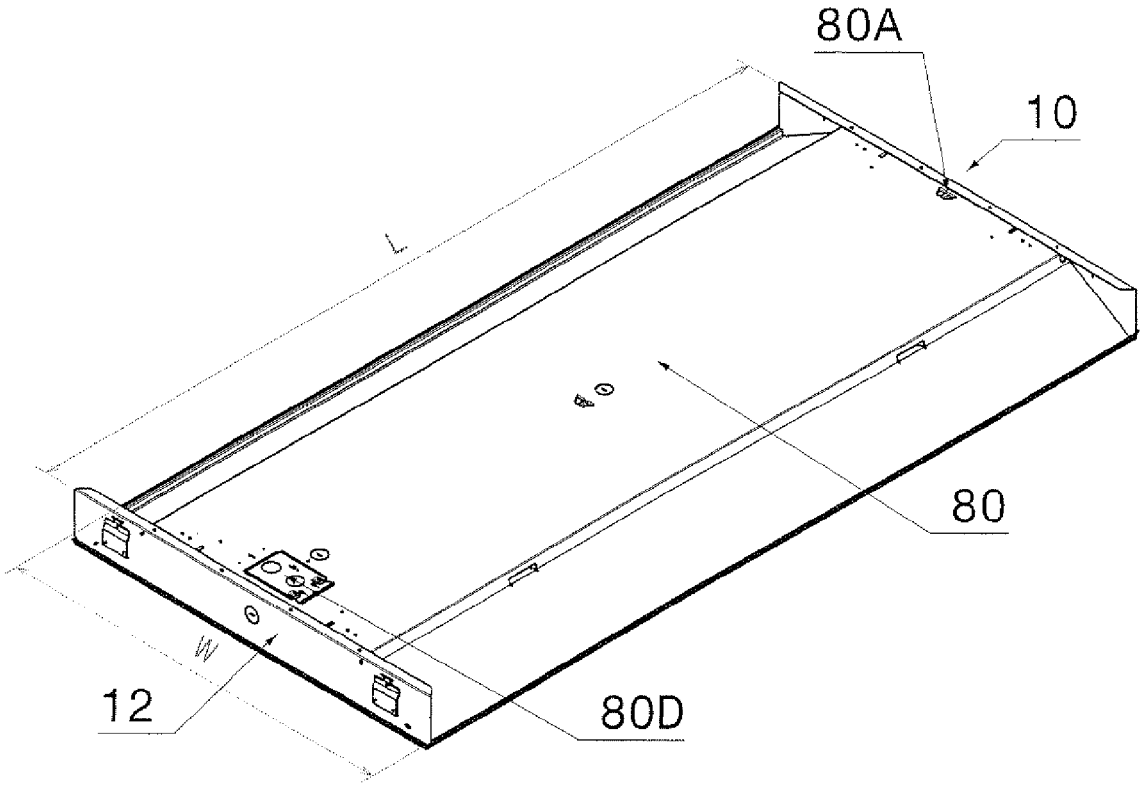
FIG. 1 is a top perspective view of the present invention 2×4 dawn light volumetric fixture which is generally rectangular in shape.
Figure 2:
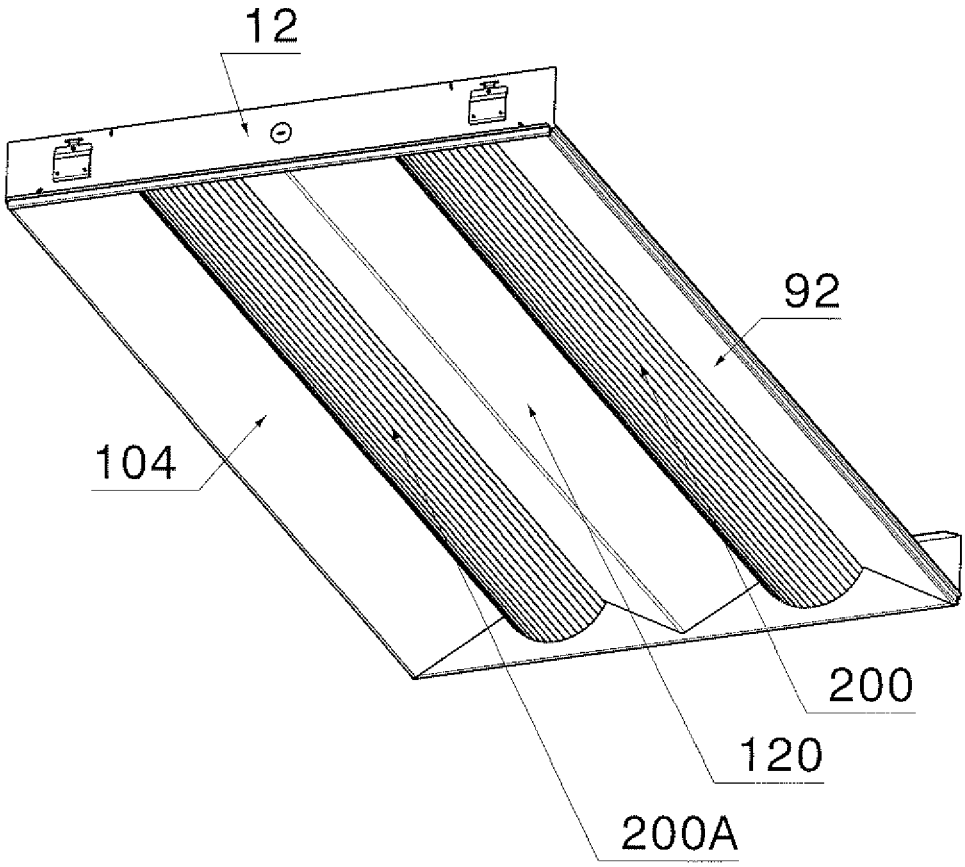
FIG. 2 is a bottom perspective view of the present invention 2×4 dawn light volumetric fixture illustrating the diffuser lenses and lens supporting structure in place.
Figure 3:
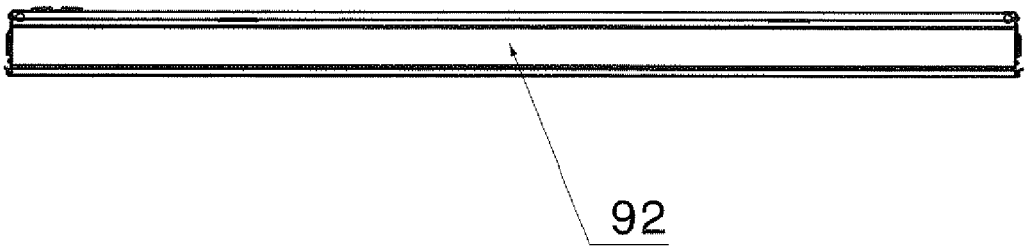
FIG. 3 is a front elevational view of the 2×4 dawn light volumetric fixture.
Figure 4:
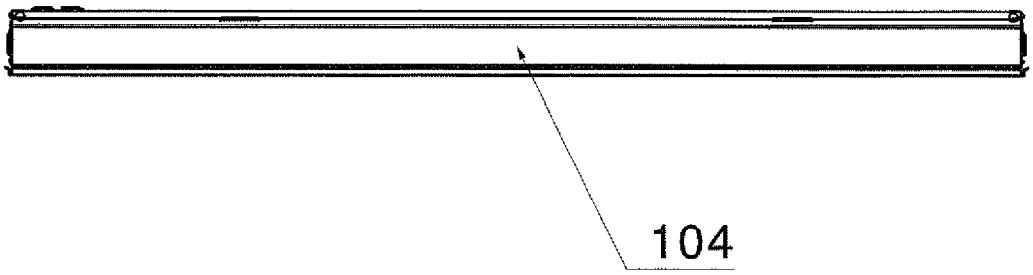
FIG. 4 is a rear elevational view of the 2×4 dawn light volumetric fixture.
Figure 5:
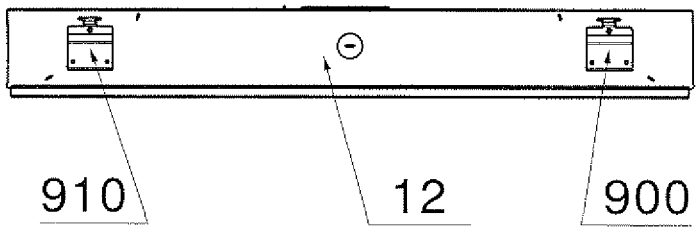
FIG. 5 is a left side elevational view of the 2×4 dawn light volumetric fixture.
Figure 6:
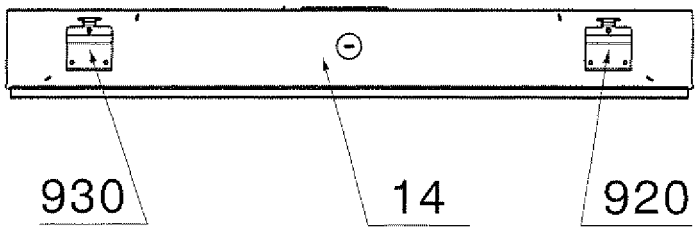
FIG. 6 is a right side elevational view of the 2×4 dawn light volumetric fixture.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a fluorescent lightbulb lighting fixture for indoor lighting which includes a pair of diffuser lens baskets and reflectors. The fixture can be in various sizes. The preferred embodiment for the present invention has a generally rectangular shape with a given length "L" and width "W" which by way of example can be 4 feet by 2 feet.

The present invention fluorescent light lighting fixture is shrouded in a frosted acrylic or perforated metal diffuser to defuse the light emitted from the fluorescent light bulbs.

Referring to FIGS. 1-15, there is illustrated the embodiments of the present invention which are generally rectangular shape in length and width and can be approximately 4 feet long by 2 feet wide. The fluorescent light direct recessed lighting fixture 10 has a first widthwise sidewall 12, a second parallel oppositely disposed widthwise sidewall 14. A portion of the main housing 100 covers the front and rear of the fixture and also the top of the fixture. There is no separate front wall, back wall, or top.

One key innovation of the present invention is that fixture 10 is illuminated exclusively by fluorescent bulbs. Referring to FIGS. 7A through 11, the invention contains two spaced apart fluorescent bulbs 700 and 710. The sockets which retain the fluorescent light bulbs are affixed to interior wall 86 of main housing 100. Both fluorescent bulbs 700 and 710 are horizontally oriented and spaced apart so that the two fluorescent bulbs extend for approximately the entire length "L" of the fixture 10.

One of the unique innovations of the present invention is that each fluorescent bulb 700 and 710 are respectively shrouded in a frosted acrylic or perforated metal diffuser lens 200 or 200A which is in the shape of a longitudinal basket extending the entire interior length of the fixture 10 and which serves to diffuse the light from the fluorescent bulbs.

Figure 7A:
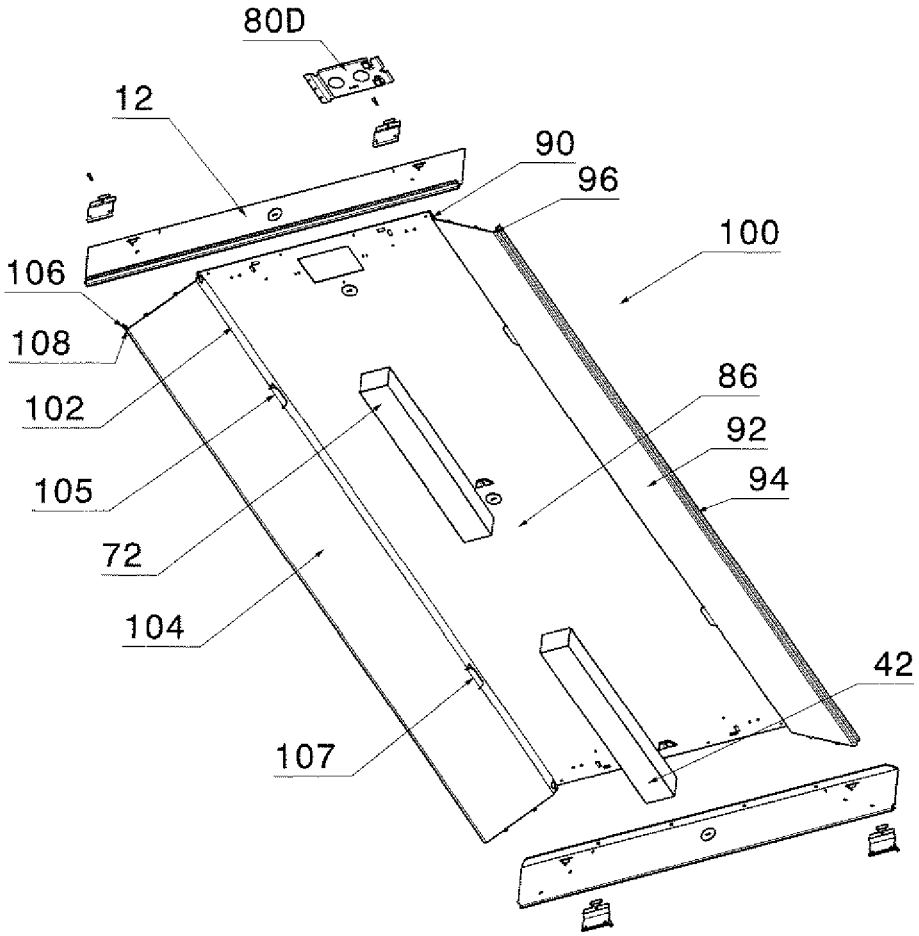
FIG. 7A is an exploded view illustrating some of the component parts of the body of the 2×4 dawn light volumetric fixture.
Figure 7B:
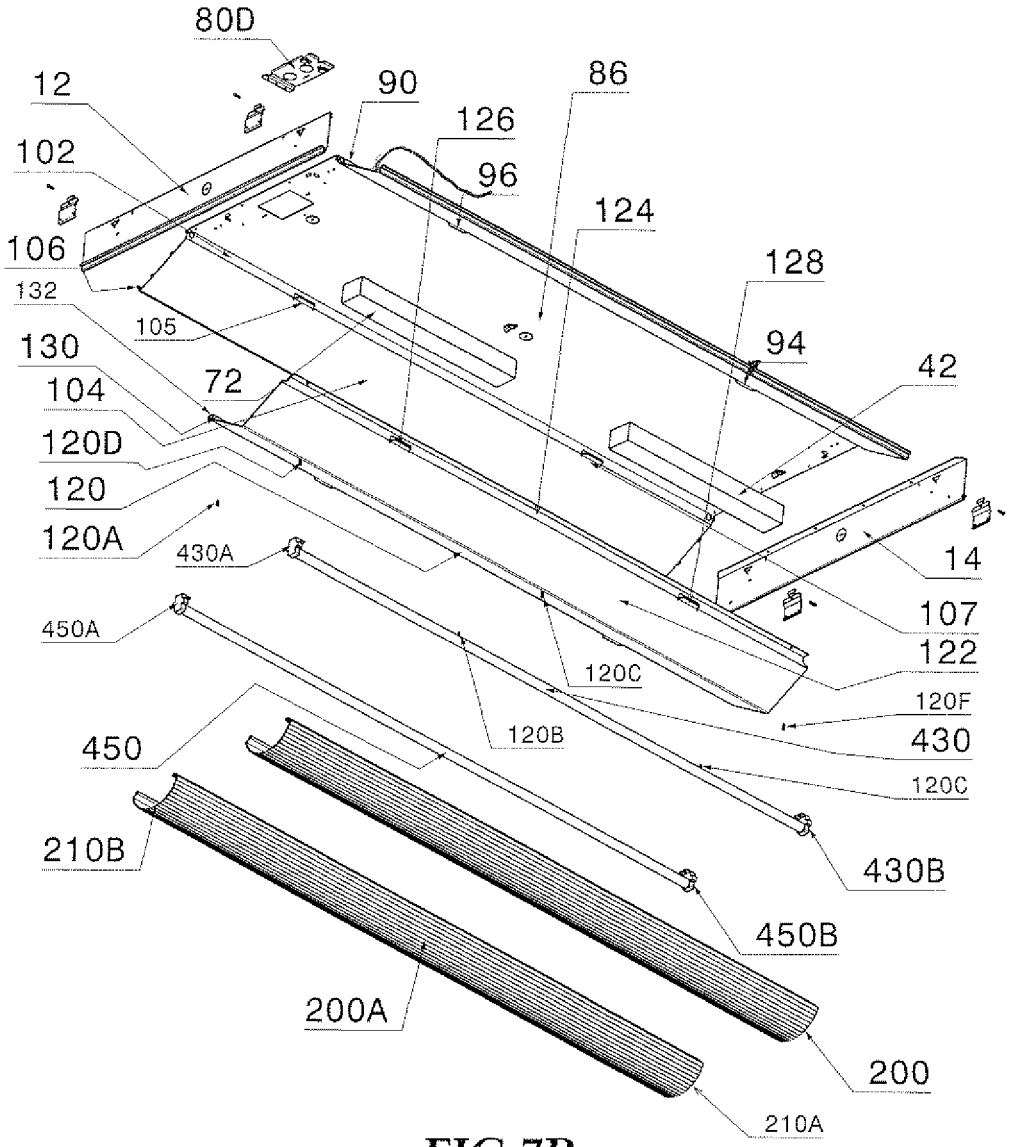
FIG. 7B is an exploded view illustrating additional component parts of the 2×4 dawn light volumetric fixture.
Figure 8:
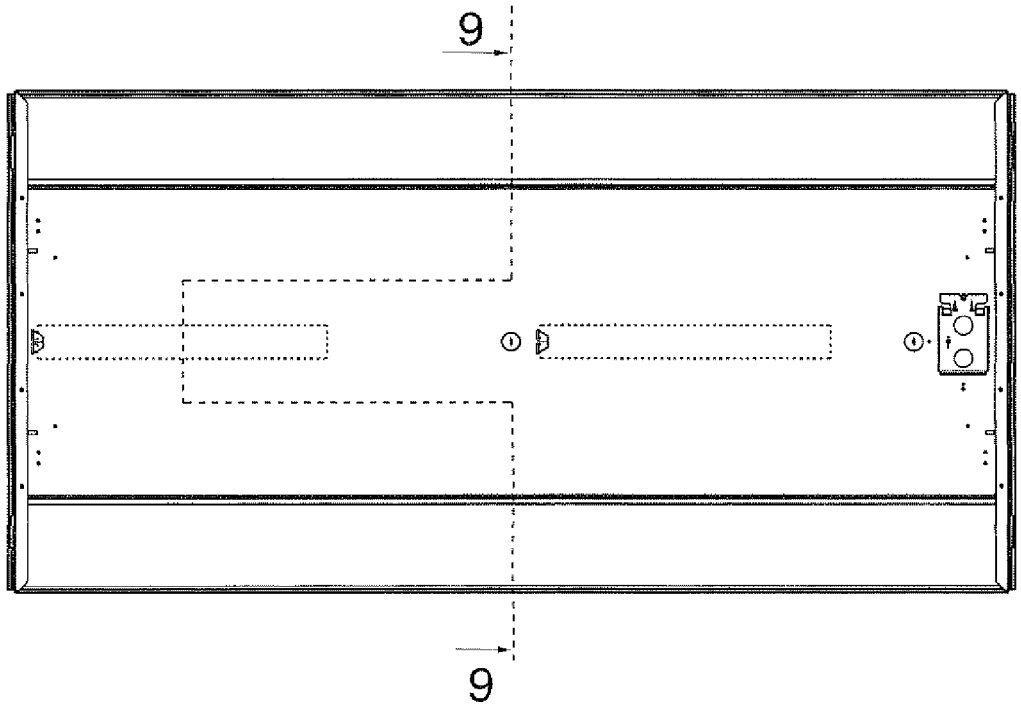
FIG. 8 is a top plan view of the 2×4 dawn light volumetric fixture with section line 9-9.
Figure 11:
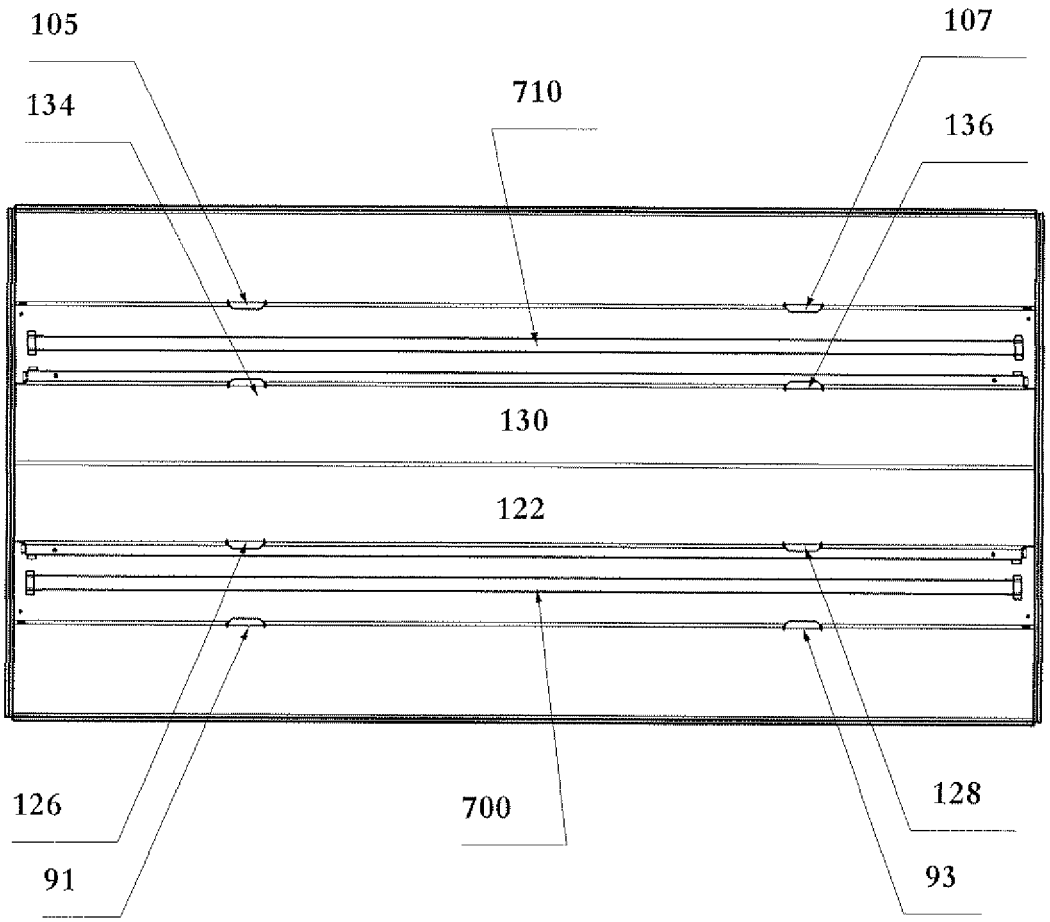
FIG. 11 is a bottom plan view of the fixture with the diffuser lenses removed, illustrating the fluorescent bulbs.
Figure 12:
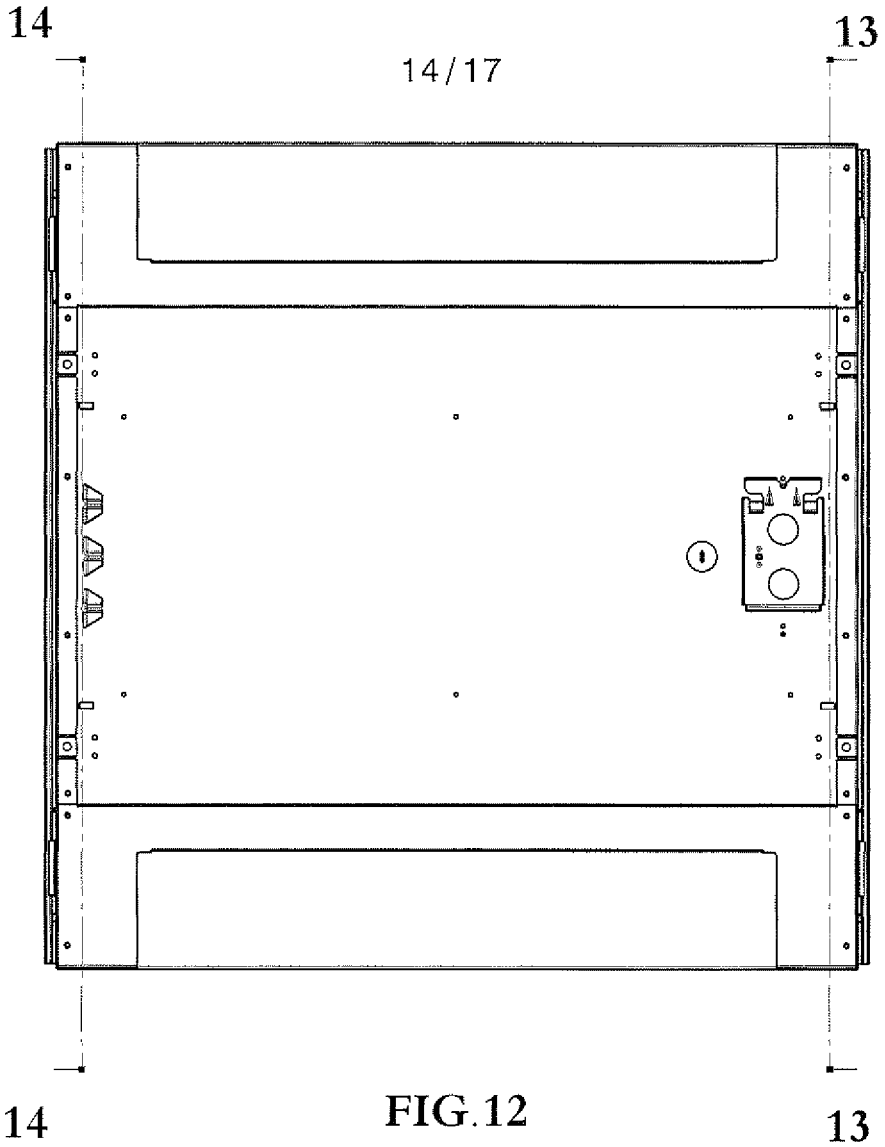
FIG. 12 is a top plan view of the 2×4 dawn light fixture with section lines 13-13 and 14-14.

The key physical components of the 2×4 dawn light shadow fixture 10 are illustrated in the perspective view of FIG. 1 and the exploded views of FIGS. 7A and 7B. The main body 100 comprises a top surface 80 and interior surface 86 of top surface 80. Top surface 80 extends to a first vertical transition wall 90 which in turn extends to a first angled wall 92 which extends at an angle relative to top wall 80 and terminates in a lower grooved wall 94 having a gap 96 between wall 94 and angled wall 92. The first vertical transition wall 90 and first angled wall 92 also function as the front wall of the fixture 10. Top surface 80 also extends to a second transition wall 102 which in turn extends to a second angled wall 104 which extends at an angle relative to top wall 80 and terminates in a lower grooved wall 106 having a gap 108 between wall 106 and second angled wall 104. Second transition wall 102 and second angled wall 104 also function as the rear wall of the fixture. First angled wall 92 and second angled wall 104 are mirror images of each other. As best illustrated in FIG. 11, first angled wall 92 has pair of spaced apart first channel receiving or gripping members 91 and 93. Second angled wall 104 has a pair of spaced apart second channel receiving or gripping members 105 and 107.

A primary ballast 42 is affixed to interior wall 86. An emergency ballast or battery 72 is also affixed to interior wall 86 and is aligned with ballast 42.

Referring to FIG. 7B, the fixture 10 further comprises a V-shaped ballast cover 120 having a first angled wall 122 extending to a first vertical transition wall 124. A pair of spaced apart second channel receiving or gripping members 126 and 128 are located at the junction where the first angled wall 122 contacts the first vertical interior transition wall 124. The V-shaped ballast cover 120 also has a second angled wall 130 extending to a second vertical transition wall 132. A pair of spaced apart first channel receiving or gripping members 134 and 136 (see FIG. 11) are located at the junction where the second angled wall 130 contacts the second vertical transition wall 132.

Figure 9:
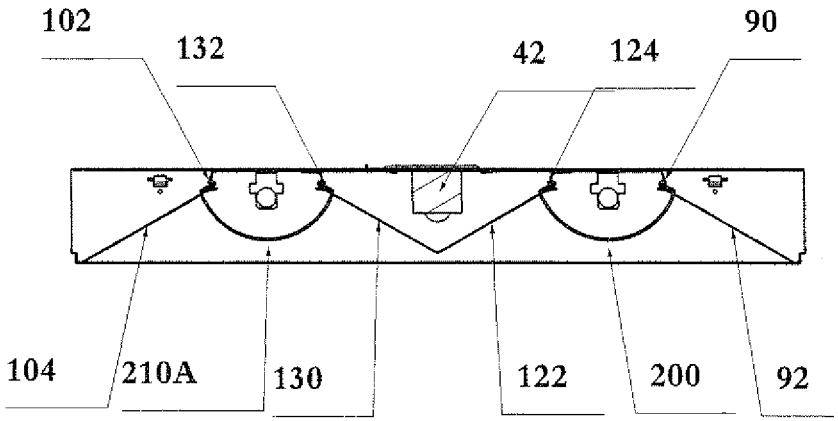
FIG. 9 is a cross-sectional view taken along line 9-9 of FIG. 8.
Figure 9B:
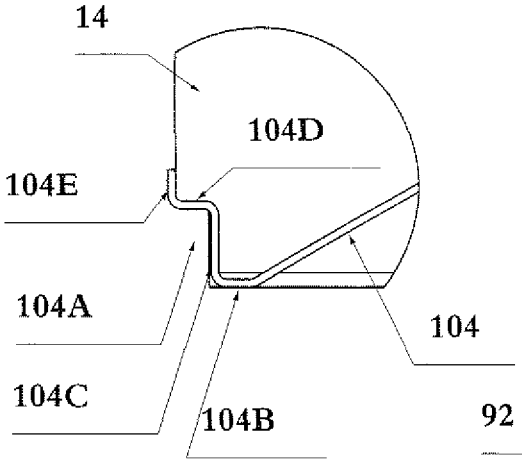
FIG. 9B is an enlarged view of the lower left hand corner illustrated in FIG. 9.
Figure 9A:
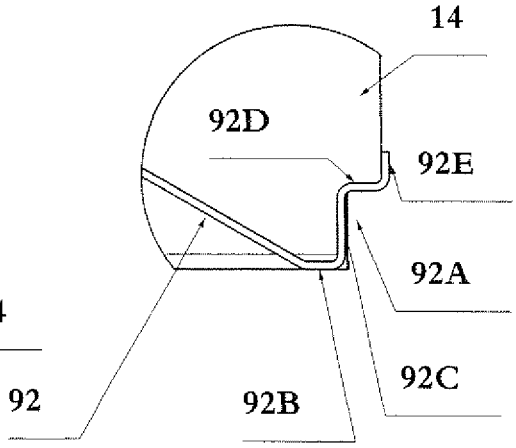
FIG. 9A is an enlarged view of the lower right hand corner illustrated in FIG. 9.

Referring to FIGS. 9, 9A and 9B, the straight first angled wall 92 extends at a downward approximately 45 degree angle and terminates in a bottom end 92A having a lower horizontal section 92B extending to a first vertical section 92C which extends to a second upper horizontal section 92D which extends to a second upper vertical section 92E. The bottom of each respective widthwise sidewall 12 and 14 rests on upper horizontal section 92D and against upper vertical section 92E.

Similarly the straight second angled wall 104 extends at a downward approximately 45 degree angle and terminates in a bottom end 104A having a lower horizontal section 104E extending to a first horizontal section 104C which extends to a second upper horizontal section 104D which extends to a second upper vertical section 104E. The bottom of each respective widthwise section within sidewalls 12 and 14 rests on upper horizontal section 104C and against upper vertical section 104E.

Figure 10A:
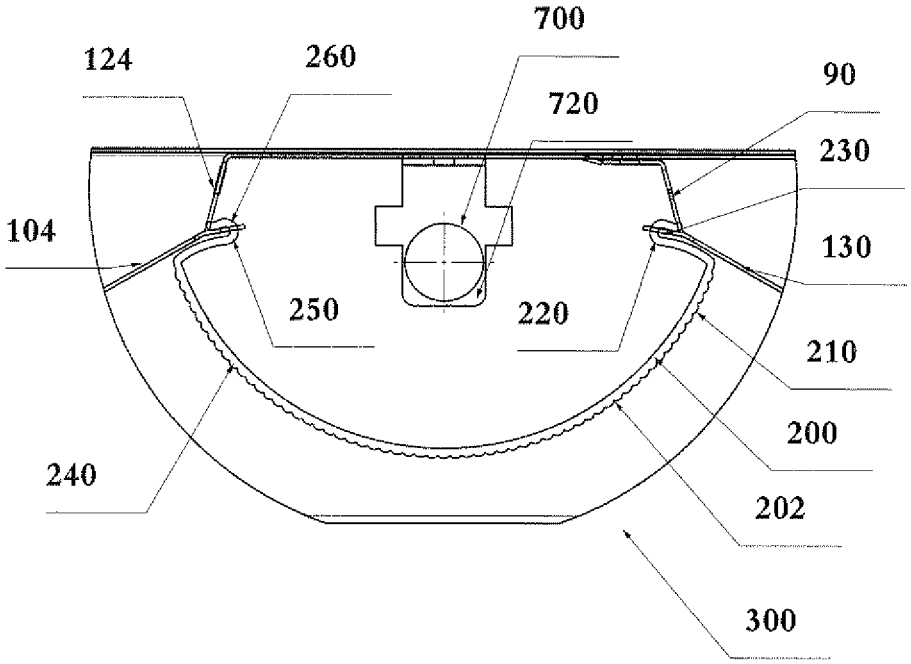
FIG. 10A is an enlarged view illustrating the fluorescent bulbs and the first diffuser and attachment members.

Referring to FIG. 10A, the light from the fluorescent bulb 700 is transmitted through the diffuser lens 200. An additional improvement is the incorporation of a wavy interior surface 202 on the interior of the diffuser lens 200. The wavy interior surface causes the lights from the fluorescent bulbs to bounce off the wavy surface and provide a smooth warm illumination glow. The wavy surface also serves to hide the locations where illumination from the fluorescent bulbs are emitted.

As best illustrated in FIG. 10A, the diffuser lens 200 is arc shaped having a first arcuate sidewall 210 which terminates in a bent hook end 220 having a channel or gap 230 within the hook end 220. The diffuser lens 200 also has a parallel second arcuate sidewall 240 which terminates in a bent hook end 250 having a channel 260 within the hook end 250. A first reflector support assembly 300 includes first channel receiving or gripping members 91 and 93 inserted into channel 230 of diffuser lens 200 and first gripping members 126 and 128 from first angled wall 122 of V-shaped ballast cover 120 are inserted into channel 260. The first angled wall 92 is supported by transition wall 90 affixed to interior surface 86 of top cover 80. V-shaped ballast cover 120 is affixed to interior surface 86 of top cover 80 by screws such as screws 120A, 120B, 120C, 120D, 120E and 120F illustrated in FIG. 7B. To remove diffuser lens 200, an inward force is applied to remove channel 230 from gripping members 91 and 93 or channel 260 is removed from first gripping members 126 and 128. The diffuser lens 200 covers fluorescent light bulb numbered 700 in FIG. 10A. Alternatively, the fluorescent lightbulb is numbered 430 in FIG. 7B, having bulb retainers 430A and 430B at opposite ends.

Figure 10B:
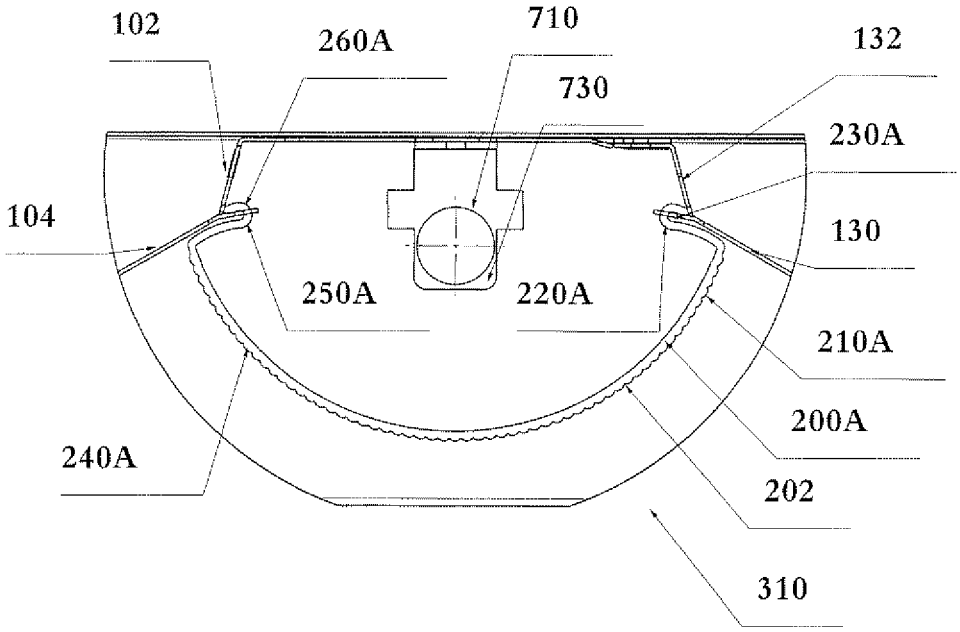
FIG. 10B is an enlarged view illustrating the fluorescent bulbs and the second diffuser and attachment members.

Referring to FIG. 10B, parallel diffuser lens 200A covers fluorescent light bulb 710. As best illustrated in FIG. 10B, the diffuser lens 200A is arc shaped having a first arcuate sidewall 210A which terminates in a bent hook end 220A having a channel or gap 230A within the hook end 220A. The diffuser lens 200A also has a parallel second arcuate sidewall 240A which terminates in a bent hook end 250A having a channel or gap 260A within the hook end 250A. A second reflector support assembly 310 includes second channel receiving or gripping members 134 and 136 from second angled wall 130 of V-shaped ballast cover 120 inserted into channel 230A of diffuser lens 200A and second gripping members 105 and 107 from second angled wall 104 are inserted into channel 260A. The second angled wall 104 is supported by interior transition wall 102 affixed to interior surface 86 of top cover 80. V-shaped ballast cover 120 is affixed to interior surface 86 of top cover 80 by screws such as screws 120A, 120B, 120C, 120D, 120E and 120F illustrated in FIG. 7B. To remove diffuser lens 200A having ends 210A and 210B, an inward force is applied to remove channel 230A from gripping members 134 and 136 or channel 260A is removed from gripping members 105 and 107 of second angled wall 104. The diffuser lens 200A covers fluorescent bulb numbered 710 in FIG. 100A. Alternatively, the fluorescent bulb is numbered 450 in FIG. 7B having bulb retainers 450A and 450B at opposite ends.

Since the fluorescent bulbs 700 and 710 are horizontally oriented, light will shine through the respective diffusers 200 and 200A and give a glowing effect to the fixture 10. In addition, the wavy interior surface 202 on the diffuser lens (and 200B on diffuser lens 200A) provides the added advantages previously discussed.

The purpose of the emergency battery pack or emergency ballast 72 is to light at least one fluorescent bulb in the event power goes out so that an individual will have lighting to escape from a building should power go out.

The pair of diffusers 200 and 200A are unique to the present invention.

The ballast or driver 42 can be a dimming driver. Alternatively, it is possible to have a dual level switch where two hot leads are brought in each switch independently that can turn on and off a subgroup of one of the fluorescent bulbs. By way of example, a dimming switch can have a dimming driver which can have a rotating switch wherein the amounts of light emitted from each fluorescent bulb 700 and 710 can be varied and can be brighter or dimmer. Alternatively, the fixture can have dual level switching where the fluorescent bulb 700 can be turned on with one switch and the fluorescent bulb 710 can be turned on with a separate switch. Therefore, it is within the spirit and scope of the present invention to have at least one fluorescent light turned on with a switch. Therefore, one could go full power mode or could go dimming mode on the driver. The present invention can also utilize a sliding dimmer switch The diffusers 200 and 200A are each primarily frosted acrylic although it can be perforated metal. For the fluorescent bulbs 700 and 710, there are different shades of white. There is a warm white, a cool white and daylight. Therefore, the fluorescent bulbs can be warm white, cool white, and daylight.

In the case of the emergency battery pack or emergency diffuser 72, it will go on if the power goes out and at least a certain subset of the fluorescent bulbs will be lit. The special circuit design will be a nickel cadmium battery for the emergency battery pack 72 so it will last at least 90 minutes, The idea is to preserve battery life so that the emergency battery will only be lighting one fluorescent bulb to provide light in order to allow someone to exit the building in case there is an emergency.

Referring to FIG. 1, the top wall 80 has an access door 80D to gain access to the junction box for wiring. The top wall 80 also has at least one knockout 80A, for wiring access.

First angled wall 92 and second angled wall 104 are straight—that means that they are neither convex or concave.

Figure 13:
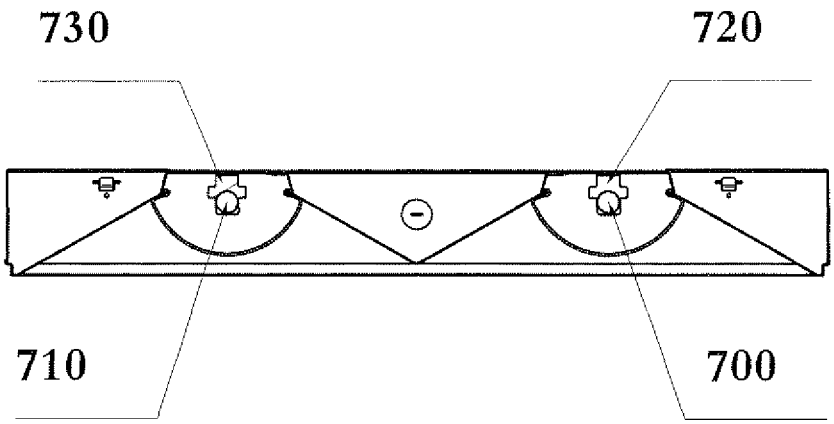
FIG. 13 is a cross-sectional view taken along line 13-13 of FIG. 12.
Figure 14:
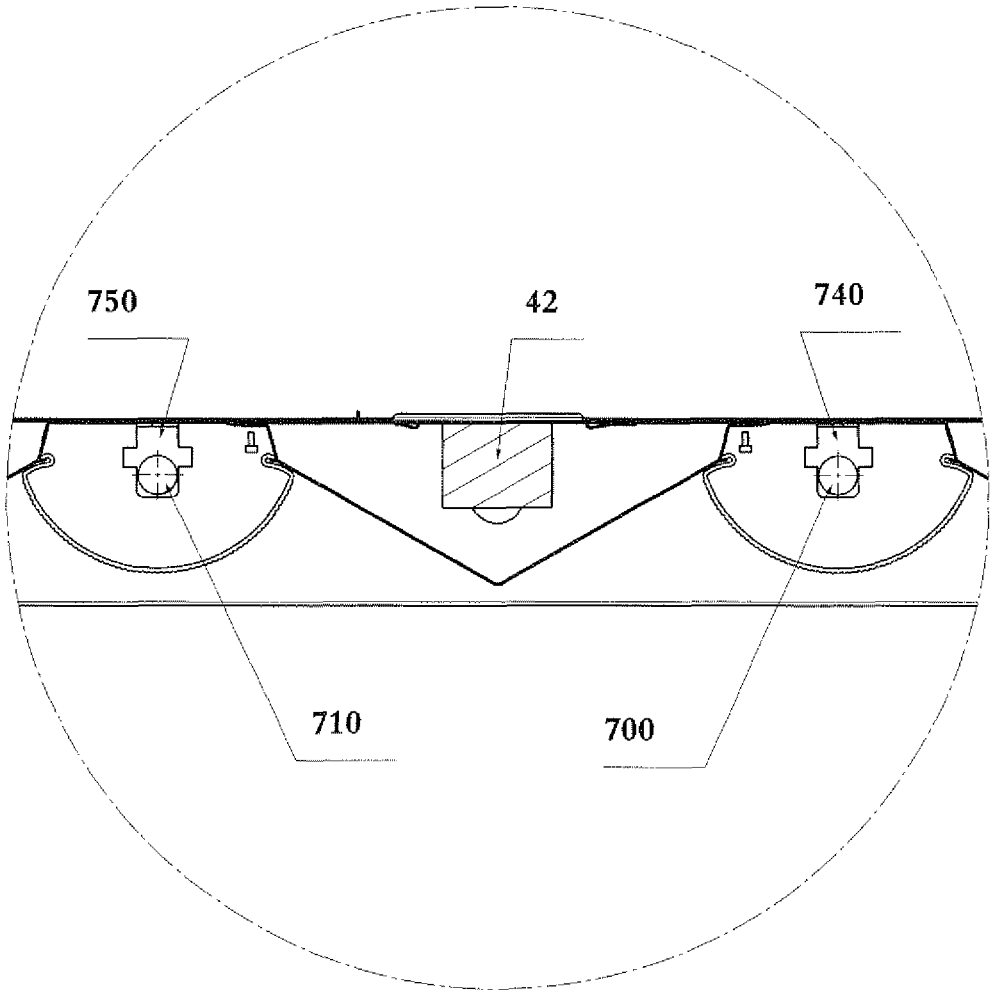
FIG. 14 is a cross-sectional vie take along line 14-14 of FIG. 12.

As illustrated in FIG. 13, sockets 720 and 730 are on opposite locations on the interior of sidewall 14 to retain fluorescent bulbs 700 and 710. Diffuser 200 covers fluorescent bulb 700 and diffuser 200A covers bulb 710. Similarly, as illustrated in FIG. 14, sockets 740 and 750 are on opposite locations on the interior of sidewall 12 to retain fluorescent bulbs 700 and 710. Diffuser 200A covers fluorescent bulb 710.

Since the fluorescent bulbs 700 and 710 are horizontally oriented, light will shine through the respective diffusers 200 and 200A and give a glowing effect to the fixture 10.

Figure 15:
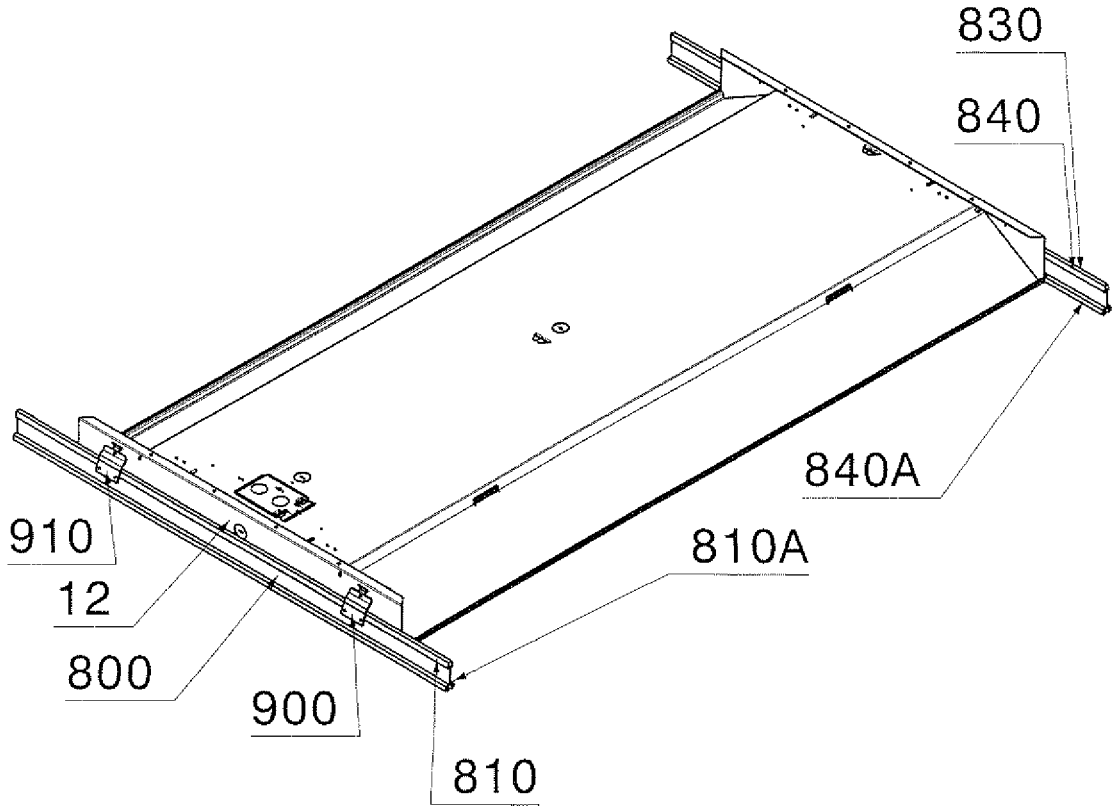
FIG. 15 is a perspective view of the 2×4 dawn light volumetric fixture attached to bar hangers.

Referring to FIG. 15, the fixture 10 is affixed to a ceiling structure by parallel oppositely disposed fine hanger bars 800 and 830. First hanger bar 800 has an upper rail 810 which fits against lower horizontal section 104B and first vertical section 104C of first reflector support assembly 300 and is affixed to sidewall 12 by a pair of attachment clips 900 and 910 which is affixed to hanger bar 800 by screws at one end and to sidewall 12 at its opposite end. Track 800 has a lower rail 810A. Similarly, second hanger bar 830 has as upper rail 840 which fits against lower horizontal section 92B and first vertical wall 92C of second reflector assembly 310 and is affixed to sidewall 14 by a second pair of attachment clips 920 and 930 comparable to attachment clips 900 and 910. Track 830 has a lower rail 840A.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A fluorescent light recessed direct lighting fixture comprising:

a. a housing having a first width-wise sidewall, a second oppositely disposed width-wise sidewall;

b. a main body comprising a horizontal wall having a top surface and interior surface, a first vertical interior transition wall extending to a first straight angled wall which extends at an angle relative to the horizontal wall and terminates in a first lower grooved wall having a gap between the first lower grooved wall and the straight angled wall, the first vertical interior transition wall and first straight angled wall serving as a first lengthwise wall of the fixture, the top surface also comprising a second vertical transition wall extending to a second straight angled wall which extends at an angle relative to the horizontal wall and terminates in a second lower grooved wall having a gap between the second lower grooved wall and the second straight angled wall, the second vertical transition wail and second straight angled wall serving as a second lengthwise wall of the fixture, the first straight angled wall and second straight angled wall are mirror images of each other;

c. the first straight angled wall has a pair of spaced apart first channel receiving or gripping members, the second straight angled wall has a pair of spaced apart second channel receiving or gripping members;

d. the fixture further comprises a V-shaped ballast cover having a first angled wall extending to a first vertical interior transition wall, and a pair of spaced apart second channel receiving or gripping members located at the junction where the first angled wall contacts the first vertical interior transition wall of the main body, the V-shaped ballast cover also comprises a second angled wall extending to wall, a second interior vertical transition wall, and a pair of spaced apart first channel receiving or gripping members located at the junction where the second angled wall contacts the second vertical interior transition wall of the main body;

e. light from a first fluorescent bulb is transmitted through a first diffuser lens, the first diffuser lens is arc shaped having a first arcuate sidewall which terminates in a first bent hook end having a first gap within the first bent hook end, the first diffuser lens also has a parallel second arcuate sidewall which terminates in a second bent hook end having a second gap within the second bent hook end, a first reflector support assembly which includes the pair of spaced apart first channel receiving or gripping members from the first angled wall inserted into the first gap in the first bent hook end of the first arcuate sidewall of the first diffuser lens and the spaced apart second channel receiving or gripping members from the first angled wall of the V-shaped ballast cover are inserted into the second gap within the second bent hook end of the second arcuate sidewall, the first arcuate wall is supported by the first vertical transition wall affixed to the main body, the V-shaped ballast cover is affixed to the interior surface of the horizontal wall by screws, so that to remove the first diffuser lens, an inward force is applied to remove the first gap from the pair of spaced apart first channel receiving or gripping members of the first arcuate sidewall or the second gap is removed from the pair of spaced apart second channel receiving or gripping members of the V-shaped ballast cover, the first diffuser lens covers the first fluorescent bulb;

f. a second parallel diffuser lens covers a second fluorescent bulb, the second diffuser lens is arc shaped having a first arcuate sidewall which terminates in a first bent hook end having a first gap within the first bent hook end, the second diffuser lens also has a parallel second arcuate sidewall which terminates in a second bent hook end having a second gap within the second bent hook end, a second reflector support assembly includes the pair of spaced apart second channel receiving or gripping members from the second angled wall of the V-shaped ballast cover inserted into the first bent hook end of the second diffuser lens and the pair of spaced apart first channel receiving or gripping members from the second angled wall inserted into the second bent hook end of the second diffuser lens, the second arcuate wall is supported by the second vertical transition wall affixed to the main body, the V-shaped ballast cover is affixed to the interior surface of the horizontal wall by screws, to remove the second diffuser lens, an inward force is applied to remove the first bent hook end of the second diffuser lens from the pair of spaced apart second channel receiving or gripping members of the V-shaped ballast cover or the second bent hook end of the second diffuser lens is removed from the pair of spaced apart first channel receiving or gripping members of the second arcuate wall, the second diffuser lens covers the second fluorescent bulb;

g. the first straight angled wall having a downward approximately 45 degree angle and terminates in a bottom end having a lower horizontal section extending to a first vertical section which extends to has a first upper horizontal section which extends to a first upper vertical section, the bottom of the second width-wise sidewall rests on the first upper horizontal section and against the first upper vertical section;

h. similarly the second straight angled wall extends at has a downward approximately 45 degree angle and terminates in a bottom end having a lower horizontal section extending to a second vertical section which has a second upper horizontal section which has a second upper vertical section, the bottom of the first width-wise sidewall rests on the second upper horizontal section and against the second upper vertical section; and i. the first straight angled wall is not concave and not convex and the second straight angled wall is not concave and not convex.

2. The fluorescent light recessed direct lighting fixture in accordance with claim 1, further comprising: a first single driver attached to the interior wall of the horizontal wall of the main body.

3. The fluorescent light recessed direct lighting fixture in accordance with claim 2 further comprising the first single driver is accessed by removing the V-shaped ballast cover and at least one diffuser.

4. The fluorescent light recessed lighting fixture in accordance with claim 2, further comprising a second driver which functions as an emergency driver, and the second driver is also attached to the interior surface of the horizontal wall of the main body and is aligned with the first single driver.

5. The fluorescent light recessed lighting fixtures in accordance with claim 4 further comprising the second driver is accessed by removing the V-shaped ballast cover and at least one diffuser.

6. The fluorescent light recessed direct lighting fixture in accordance with claim 1, further comprising: each diffuser being frosted and made of acrylic material.

7. The fluorescent light recessed direct lighting fixture in accordance with claim 1, further comprising: each diffuser being made of perforated metal.

8. The fluorescent light direct recessed lighting fixture in accordance with claim 4 where during a power failure in which power to the fixture is interrupted, the second driver will enable at least one fluorescent bulb to remain lit to provide illumination for a given period of time.

9. The fluorescent light direct recessed lighting fixture in accordance with claim 1, further comprising dimming means by which the illumination from at least one of the fluorescent bulbs is dimmed.

10. The fluorescent light direct recessed lighting fixture in accordance with claim 1, further comprising:

a. the fixture is affixed to a ceiling structure by parallel oppositely disposed fine hanger bars, a first hanger bar has an upper rail which fits against the lower horizontal section and first vertical section of first reflector support assembly and is affixed to the first width-wise sidewall by a pair of attachment clips which is affixed to the first hanger bar by screws at one end and to the first width-wise sidewall at its opposite end; and b. similarly, a second hanger bar has as upper rail which fits against the lower horizontal section and first vertical wall of the second reflector assembly and is affixed to the second widthwise sidewall by a second pair of attachment clips.

11. The fluorescent light direct light recessed lighting fixture in accordance with claim 1, further comprising the fixture is approximately four (4) feet long and is approximately two (2) feet wide.

12. A fluorescent light recessed direct lighting fixture comprising:

a. a housing having at least a top wall, a first transverse wall perpendicular to the top wall and a second transverse wall perpendicular to the top wall;

b. a main body comprising a top surface and interior surface of the top surface, the top surface extends to a first vertical connecting member which in turn extends at a first straight angled wail which acts as a reflector and which extends at an angle relative to the top wall and terminates in a first lower grooved wall having a gap between the first lower grooved wall and the first straight angled wall, the top surface also extends to a second interior transition wall which in turn extends to a second straight angled wall which acts as a reflector and which extends at an angle relative to the top wall and terminates in a second lower grooved wall, the first straight angled wall and second straight angled wall are mirror images of each other;

c. the first straight angled wall has at least one first channel receiving or gripping member, the second straight angled wall has at least one spaced apart second channel receiving or gripping member;

d. the fixture further comprises a V-shaped ballast cover having a first angled wall extending to a first vertical connecting member, and at least one first channel receiving or gripping member, the V-shaped ballast cover also has a second angled wall extending to a second interior vertical connecting member, and at least one second channel receiving or gripping member;

e. light from a first fluorescent bulb affixed to the interior surface of the main body is transmitted through a first diffuser lens, the first diffuser lens is arc shaped having a first arcuate sidewall which terminates in a first bent hook end having a first gap within the first bent hook end, the first diffuser lens also has a parallel second arcuate sidewall which terminates in a second bent hook end having a second gap within the second bent hook end, a first reflector support assembly which includes at least one first channel receiving or gripping member from the first straight angled wall inserted into the first gap in the first bent hook end of the first arcuate sidewall of the first diffuser lens and the first channel receiving or gripping member from the first angled wall of the V-shaped ballast cover is inserted into the second gap within the second bent hook end of the second arcuate sidewall, the first arcuate wall is supported by the first vertical connecting member affixed to the interior surface of the top wall, the V-shaped ballast cover is affixed to the interior surface of the top wall by screws, so that to remove the first diffuser lens, an inward force is applied to remove the first gap from the at least one first channel receiving or gripping members of the first straight angled wall or the second gap is removed from the at least one second channel receiving or gripping member of the V-shaped ballast cover, the first diffuser lens covers the first fluorescent bulb;

f. light from a second fluorescent bulb affixed to the interior surface of the main body is transmitted through a second diffuser lens, the second diffuser tens is arc-shaped and covers the second fluorescent bulb affixed to the interior surface of the main body, the second diffuser lens is arc shaped having a first arcuate sidewall which terminates in a first bent hook end having a first gap within the first bent hook end, the second diffuser lens also has a parallel second arcuate sidewall which terminates in a second bent hook end having a second gap within the second bent hook end, a second reflector support assembly includes the at least one channel receiving or gripping members from the second angled wall of the V-shaped ballast cover inserted into the first bent hook end of the second diffuser lens and at least one channel receiving or gripping members from the second angled wall inserted into the second bent hook end, the second angled wall is supported by the second interior transition wall affixed to the interior surface of the top wall, the V-shaped ballast cover is affixed to the interior surface of the top wall by screws, to remove the second diffuser lens, an inward force is applied to remove the first bent hook end from the first gripping member of the V-shaped ballast covers or the second bent hook end is removed from the second gripping member of the second angled wall, the diffuser lens covers the second fluorescent bulb;

g. the first straight angled wall extends at a downward angle and terminates in a bottom end having a lower end having means to support the second transverse wall;

h. similarly the second straight angled wall extends at a downward angle and terminates in a bottom end having means to support the first transverse wall; and i. the first straight angled wall is not concave and not convex and the second straight angled wall is not concave and not convex.

13. The fluorescent light recessed direct lighting fixture in accordance with claim 12, further comprising: a first single driver attached to the interior wall of the top surface of the main body.

14. The fluorescent light recessed direct lighting fixture in accordance with claim 13, further comprising the first single driver is accessed by removing the V-shaped ballast cover and at least one diffuser.

15. The fluorescent light recessed lighting fixture in accordance with claim 13, further comprising a second driver which functions as an emergency driver, and the second driver is also attached to the interior surface of the top surface of the main body and is aligned with the first single driver.

16. The fluorescent light recessed lighting fixtures in accordance with claim 15, further comprising the second driver is accessed by removing the V-shaped ballast cover and at least one diffuser.

17. The fluorescent light recessed direct lighting fixture in accordance with claim 12, further comprising: each diffuser being frosted and made of acrylic material.

18. The fluorescent light recessed direct lighting fixture in accordance with claim 12, further comprising: each diffuser being made of perforated metal.

19. The fluorescent light direct recessed lighting fixture in accordance with claim 15, where during a power failure in which power to the fixture is interrupted, the second driver will enable at least one fluorescent bulb to remain lit to provide illumination for a given period of time.

20. The fluorescent light direct recessed lighting fixture in accordance with claim 12, further comprising dimming means by which the illumination from at least one of the fluorescent bulbs is dimmed.

21. The fluorescent light direct recessed lighting fixture in accordance with claim 12, further comprising:

a. the fixture is affixed to a ceiling structure by parallel oppositely disposed fine hanger bars, a first hanger bar has an upper rail which fits against the lower horizontal section and first vertical section of first reflector support assembly and is affixed to the first width-wise sidewall by a pair of attachment clips which is affixed to the first hanger bar by screws at one end and to the first transverse wall at its opposite end; and b. similarly, a second hanger bar has as upper rail which fits against the lower horizontal section and first vertical wall of the second reflector assembly and is affixed to the second transverse wall by a second pair of attachment clips.

22. The fluorescent light direct light recessed lighting fixture in accordance with claim 12 further comprising the fixture is approximately four (4) feet long and is approximately two (2) feet wide.

23. A fluorescent light recessed direct lighting fixture comprising:

a. a housing having a first lengthwise sidewall, a second oppositely disposed lengthwise sidewall, a first transverse wall, a second transverse wall, a top wall, the first transverse wall perpendicular to the top wall and the second transverse wall perpendicular to the top wall;

b. a main body comprising a top surface and interior surface of the top surface, a first right angled wall which acts as a reflector and which extends at an angle relative to the top wall, a second straight angled wall which acts as a reflector and which extends at an angle relative to the top wall;

c. the first straight angled wall has at least one first channel receiving or gripping member, the second straight angled wall has at least one spaced apart second channel receiving or gripping member;

d. the fixture further comprises a V-shaped ballast cover having a first angled wall and at least one first channel receiving or gripping member, the V-shaped ballast cover also has a second angled wail extending to a second interior vertical connecting member, and at least one second channel receiving or gripping member;

e. light from a first fluorescent bulb affixed to the interior surface of the main body is transmitted through a first diffuser lens, the first diffuser lens is arc shaped and is retained by the at least one first channel receiving or gripping members of the first straight angled wall and the at least one first channel receiving or gripping member from the V-shaped ballast cover, the diffuser lens covers the first fluorescent bulb;

f. light from a second fluorescent bulb affixed to the interior surface of the main body is transmitted through a second parallel diffuser lens which covers the second fluorescent bulb affixed to the interior surface of the main body, the second diffuser lens is arc shaped and is retained by the at least one spaced apart second channel receiving or gripping members of the second straight angled wall and a the at least one second channel receiving or gripping member from the V-shaped ballast cover;

g. the first straight angled wall extends at a downward angle and terminates in a bottom end having a lower end having means to support the second lengthwise sidewall;

h. similarly the second straight angled wall extends at a downward angle and terminates in a bottom end having means to support the first lengthwise sidewall; and i. the first straight angled wall is not concave and not convex and the second straight angled wall is not concave and not convex; and j. a first single driver attached to the interior surface of the top surface of the main body.

24. The fluorescent light recessed lighting fixture in accordance with claim 23, further comprising a second driver which functions as an emergency driver, and second driver is also attached to the interior surface of the top surface of the main body and is aligned with the first single driver.

25. The fluorescent light recessed lighting fixture in accordance with claim 23, further comprising a second driver which functions as an emergency driver, and second driver is also attached to the interior wall of the top of the main body and is aligned with the first single driver.

26. The fluorescent light recessed lighting fixtures in accordance with claim 25, further comprising the second driver is accessed by removing the V-shaped ballast cover and at least one diffuser.

27. The fluorescent light recessed direct lighting fixture in accordance with claim 23, further comprising: each diffuser being frosted and made of acrylic material.

28. The fluorescent light recessed direct lighting fixture in accordance with claim 23, further comprising: each diffuser being made of perforated metal.

29. The fluorescent light direct recessed lighting fixture in accordance with claim 25, where during a power failure in which power to the fixture is interrupted, the second driver will enable at least one fluorescent bulb to remain lit to provide illumination for a given period of time.

30. The fluorescent light direct recessed lighting fixture in accordance with claim 23, further comprising:

a. the fixture is affixed to a ceiling structure by parallel oppositely disposed fine hanger bars, a first hanger bar has an upper rail which fits against the lower horizontal section and first vertical section of first reflector support assembly and is affixed to the first lengthwise sidewall by a pair of attachment clips which is affixed to the first hanger bar by screws at one end and to the first transverse sidewall at its opposite end; and b. similarly, a second hanger bar has as upper rail which fits against the lower horizontal section and first vertical wall of the second reflector assembly and is affixed to the second lengthwise sidewall by a second pair of attachment clips.

31. The fluorescent light direct recessed lighting fixture in accordance with claim 23, further comprising:

a. the fixture is affixed to a ceiling structure by parallel oppositely disposed fine hanger bars, a first hanger bar has an upper rail which fits against the lower horizontal section and first vertical section of first reflector support assembly and is affixed to the first width-wise sidewall by a pair of attachment clips which is affixed to the first hanger bar by screws at one end and to the first sidewall at its opposite end; and b. similarly, a second hanger bar has as upper rail which fits against the lower horizontal section and first vertical wall of the second reflector assembly and is affixed to the second widthwise sidewall by a second pair of attachment clips.

32. The fluorescent light direct light recessed lighting fixture in accordance with claim 23, further comprising the fixture is approximately four (4) feet long and is approximately two (2) feet wide.

* * * * *